US007089990B2

(12) United States Patent
Hörmann et al.

(10) Patent No.: US 7,089,990 B2
(45) Date of Patent: Aug. 15, 2006

(54) DOOR AND GUIDE RAIL ARRANGEMENT

(75) Inventors: Thomas J. Hörmann, St. Wendel (DE); Herbert Brinkmann, Halle/Westfalen (DE)

(73) Assignee: Hürmann KG Brockhagen, Steinhagen (DE)

( * ) Notice: Subject to any disclaimer, the term of this patent is extended or adjusted under 35 U.S.C. 154(b) by 26 days.

(21) Appl. No.: 10/509,002

(22) PCT Filed: Apr. 15, 2002

(86) PCT No.: PCT/EP02/04161

§ 371 (c)(1),
(2), (4) Date: Sep. 24, 2004

(87) PCT Pub. No.: WO03/087507

PCT Pub. Date: Oct. 23, 2003

(65) Prior Publication Data

US 2005/0133170 A1 Jun. 23, 2005

(51) Int. Cl.
*E05D 15/16* (2006.01)

(52) U.S. Cl. ..... 160/201; 160/40

(58) Field of Classification Search ..... 160/201, 160/229.1, 40, 207, 196.1, 199, 206
See application file for complete search history.

(56) References Cited

U.S. PATENT DOCUMENTS 4,016,920 A * 4/1977 Shepard ..... 160/133
5,398,902 A 3/1995 Crowe
6,250,360 B1 6/2001 Ochoa
6,321,822 B1 * 11/2001 Horner et al. ..... 160/194
6,374,567 B1 * 4/2002 Mullet ..... 52/716.1
6,540,003 B1 * 4/2003 Martin ..... 160/201
6,840,300 B1 * 1/2005 Lewis, Jr. ..... 160/201

FOREIGN PATENT DOCUMENTS

| | | |
|---|---|---|
| DE | 101 13 847 A1 | 9/2002 |
| EP | 0733766 | 9/1996 |
| EP | 1114908 | 7/2001 |

* cited by examiner

*Primary Examiner*—David M Purol
(74) *Attorney, Agent, or Firm*—Friedrich Kueffner

(57) ABSTRACT

A door including a leaf which is closable between an open position and a closed position. A guide rail arrangement directs the movement of the door leaf. A fastening arrangement fixes a rail element of the guide rail arrangement to a wall by a plurality of fastening elements, each of which can be fixed to the wall as well as to the rail element. The wall has an opening which can be closed with the aid of the door leaf. A pulling arrangement can be fixed to the door leaf as well as to a drive unit and/or a weight-balancing device. At least one protective element is assigned to the guide rail arrangement. The protective element can be fixed to the rail element and/or at least one of the fastening elements and is used for bridging an intermediate space between the rail element and the wall.

7 Claims, 1 Drawing Sheet

DOOR AND GUIDE RAIL ARRANGEMENT

BACKGROUND OF THE INVENTION

The invention pertains to a door having a door leaf which can be moved between an open position and a closed position, and a guide rail arrangement to guide the movement of the door leaf.

Doors of this type are used in the form of garage doors and industrial gates. The door leaf can consist of a plurality of panels, which are hinged to each other along axes which are perpendicular to the rail element. In these types of doors, also called sectional doors, the door leaf is in a substantially vertical plane when in the closed position and is usually in an overhead horizontal position when in the open position. So that the door leaf can be guided between the closed position and the open position, a guide rail arrangement is provided. This arrangement has at least one rail element which is substantially vertical and parallel to the lateral edge of the door leaf when the door is closed; a rail element which extends overhead in a more-or-less horizontal direction and is parallel to the edge of the door leaf when the door is open; and a circular arc-shaped rail element, which connects these other two rail elements. The substantially vertical rail element can be attached by a plurality of angle-shaped fastening elements to the wall containing the opening to be closed by the door leaf.

To assist the opening movement of the door leaf, a counterbalancing device is usually provided in the form of, for example, a tension spring or torsion spring arrangement, which is tensioned during the course of the closing movement and relaxed again during the course of the opening movement. The counterbalancing device is usually connected to the door leaf by a tensioning mechanism attached to the lower edge of the door leaf. During the operation of doors of this type, it is possible for the user to be injured by coming into contact with the tensioning mechanism when reaching into the gap formed between the substantially vertical rail element and the wall. To solve these problems, angle frames with two sidepieces are usually used. The sidepieces extend over the entire length of the substantially vertical rail element and form an angle of approximately 90° with each other. The first sidepiece is attached to the wall, the second to the rail element, so that the second sidepiece makes it impossible for anyone to reach into the gap formed between the rail element and the wall. Doors with these types of angle frames are described in, for example, DE 10 113 847. Pressed-out sections are also provided in the angled frame, with the help of which, in cooperation with a latching bolt attached to the door leaf, it is possible to prevent the door leaf from moving when such movement is not desired. It is thus possible effectively to prevent the door from dropping and also to prevent it from being raised.

Nevertheless, it has been found that it is comparatively complicated and therefore correspondingly expensive to install these types of doors in which the rail element is attached to the wall by an angle frame. Doors of this type are also indicated in EP 1 114 908A2. Sliding doors with a protective element assigned to a guide rail arrangement are described in U.S. Pat. No. 5,398,902.

SUMMARY OF THE INVENTION

In view of these problems of the state of the art, the invention is based on the task of providing a door of the type described above which, first, can be installed easily and which, second, can be operated without risk of injury, and also on the task of a providing a guide rail arrangement for a door of this type.

These tasks are accomplished according to the invention by a door in which the guide rail arrangement is provided with at least one protective element that can be attached to at least one of the fastening elements and that serves to bridge the gap between the rail element and the wall. The second sidepiece has a receiving area formed as a pressed-out section to accept a fastening area of the protective element.

These types of doors are especially easy to install, because the rail element with the individual fastening elements can be attached to the wall without the use of bulky and difficult-to-handle angle frames. The risk of injury from doors according to the invention is reduced in that, after the rail element has been mounted on the wall by the fastening elements, a protective element, which bridges the gap between the rail element and the wall, is attached to the rail element and/or to at least one of the fastening elements and thus prevents anyone from reaching into this gap and running the risk of injury from contact with the tensioning mechanism.

It was realized within the scope of this invention that the increase in the number of construction elements associated with the use of the additional protective element is easy to accept in view of the greater ease of installation thus achieved. The protective element can be produced with less material than conventional angle frames, because the protective element is required only to bridge the gap between the rail element and the wall, there being no need for an additional mounting sidepiece for attaching the protective element to the wall. For this reason, the inventive door can also be produced at a lower cost than the conventional doors equipped with angle frames.

For the purpose of making it easier and less expensive to install and remove an inventive door, it has been found to be especially favorable for the protective element to be removably attached to at least one of the fastening elements and/or to the rail element.

The scope of this invention is also intended to include the use of protective elements which can be attached in a positive or a nonpositive manner to the rail element and/or to the fastening element. It is especially easy to install a protective element, however, if it can be attached positively to the fastening element and/or to the rail element.

As all ready explained above, the fastening elements of the inventive doors can be in the form of angle pieces with two sidepieces enclosing an angle of preferably about 90° with each other, where the first sidepiece can be attached to the wall and the second to the rail element. In this case, it is very easy to connect the protective element positively to the fastening element without the use of additional components by providing the second sidepiece with a receiving area to accept a fastening area of the protective element, where the receiving area can be in the form of a pressed-out section in the second sidepiece. In this case,the protective element can be secured very reliably to the fastening element by providing a boundary surface of the fastening area with a profiling which arrives in contact with a boundary surface of the second sidepiece of the fastening element and which opposes the separation of the protective element from the fastening element. This profiling can be in the form of hooks or simple webs which taper to a point on the boundary surface of the fastening area.

To improve the visual appearance and to achieve a further increase in the operating reliability of the inventive door, it is preferable for the protective element to have a cover area, where an intermediate space, which is designed to receive fastening elements serving to fasten the rail element to the second sidepiece, is formed between a boundary surface of the second sidepiece of the fastening element opposite the rail element and the cover area. The fastening arrangement used to fasten the rail element to the second sidepiece can be in the form of screw bolts passing through the rail element and the second sidepiece with nuts screwed onto them, where these nuts can be accommodated in the intermediate space formed between the cover area and the second sidepiece of the fastening element. This has the effect of reducing the risk of injury from the nuts, which would otherwise be exposed.

The protective element of an inventive door has no load-bearing function. Therefore, it can be produced inexpensively out of plastic. As already explained above, this invention can be used to particular advantage in sectional doors, in which the door leaf has a plurality of panels, which are hinged to each other along axes which are substantially perpendicular to the rail element.

As can be derived from the preceding explanation of the inventive doors, a guide rail arrangement suitable for the production of these types of doors, which arrangement has a rail element which can be attached to a wall and a fastening arrangement comprising a plurality of fastening elements which can be attached on one side to the wall and on the other side to the rail element, is characterized essentially in that at least one protective element is provided which can be attached to the rail elements and/or to at least one of the fastening elements and which serves to bridge the gap between the element and the wall.

BRIEF DESCRIPTION OF THE DRAWING

The invention is explained below with reference to the drawing, to which explicit reference is made with respect to all of the details which are essential to the invention but not discussed in detail in the specification. The single FIGURE of the drawing shows a horizontal cross section through an inventive door in the area of the substantially vertical rail element.

DETAILED DESCRIPTION OF THE INVENTION

Figure 1:
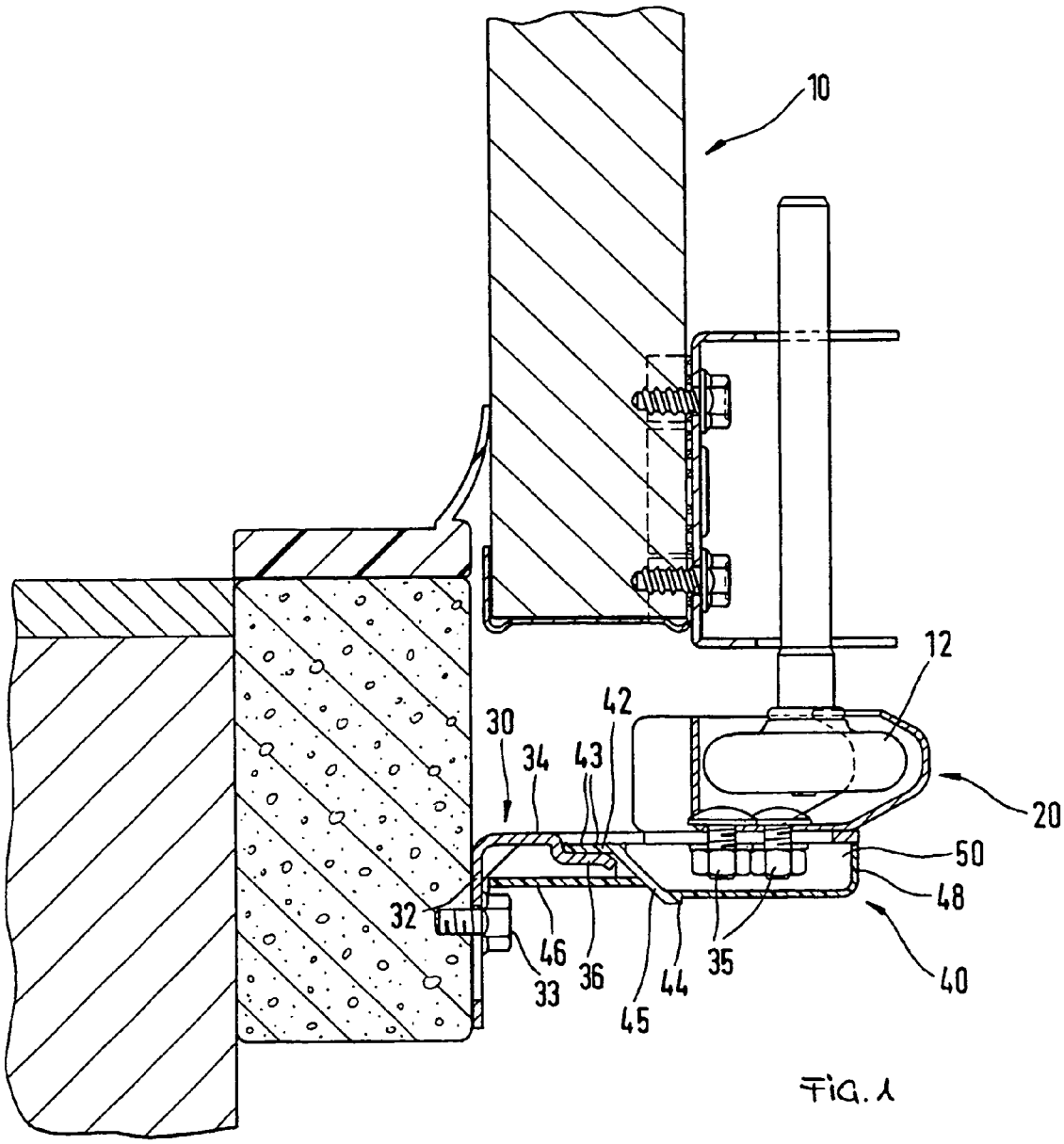

The door shown in the drawing comprises a door leaf with a plurality of panels hinged to each other, only one of these panels 10 being shown in the drawing; a guide rail arrangement with a substantially vertical rail element 20 parallel to the lateral edge of the door leaf when the door is closed; a plurality of fastening elements 30 for attaching the rail element to a wall containing the opening to be closed by the door leaf; and a protective element 40.

A guide roller 12, which is held in the rail element 20, is attached to the panel 10, 50 that the movement of the door leaf can be guided by the guide roller 12 accommodated in the rail element 20. The fastening element 30 is designed in the form of an angle piece with a first sidepiece 32, which is attached by a screw 33 to the wall, and a second sidepiece 34, which forms a right angle to the sidepiece 32. To attach the rail element 20 to the second sidepiece 34 of the fastening element 30, two screws 35 in all are provided, which pass through the rail element 20 and this second sidepiece 34. Nuts are screwed onto the ends of these screws 35 facing away from the rail element 20 to ensure a reliable attachment of the rail element 20 to the second sidepiece 34 of the fastening element 30. The rail element 20 is attached to the wall by a plurality of fastening elements 30 of the type shown in the drawing, where a predetermined spacing is maintained between the individual fastening elements 30.

To bridge the gap remaining between the rail element 20 and the wall, a protective element 40 is provided. This protective element 40 can be pushed onto the fastening elements 30 after the rail element 20 has been fastened to the wall by the fastening elements 30. For this purpose, the second sidepiece 34 of the fastening element 30 has a pressed-out section 36, which forms a receptacle for a fastening area 42 of the protective element 40. This fastening area 42 is designed in the form of a web, which is substantially parallel to the second sidepiece 34. On the boundary surface facing the second sidepiece 34, the fastening area 42 is provided with a profiling in the form of webs 43, which taper down to a point; these webs prevent the protective element 40 from being pulled out of the receptacle formed by the pressed-out section 36. Adjacent to the fastening area 42, the protective element 40 has an outward-slanting web 45, which merges with a web 44, parallel to the second sidepiece 34; the web 44 merges in turn with a web 48 extending toward the second sidepiece 34. This has the result of creating a cover area, which, together with the boundary surface of the second sidepiece 34 opposite the rail element 20, creates an intermediate space 50, in which the nuts 35 are accommodated. In addition to the cover area, the protective element has a protective area 46, which proceeds from the sidepiece 45 toward the wall, parallel to the second sidepiece 34 of the fastening element 30; this protective area bridges the gap formed between the rail element and the wall. Because the protective element 40 has no load-bearing function, it can be produced of plastic in the inventive embodiment shown in the drawing.

The invention is not limited to the exemplary embodiments explained on the basis of the drawing. On the contrary, it includes the use of protective elements which are attached materially or nonpositively to the fastening element and/or to the rail element. In addition, the protective element can also be designed without a cover area. In this case, it is advisable for the protective element to be realized in the form of a U-shaped profile, one of the sidepieces of the protective element being accepted positively in a receptacle of the fastening element, while the other, longer sidepiece of the protective element bridges the gap formed between the rail element and the wall.

What is claimed is:

1. A door, comprising: a door leaf which can be moved between an open position and a closed position; a guide rail arrangement to guide the movement of the door leaf, the guide rail arrangement including a vertical rail element; a fastening arrangement for attaching the vertical rail element of the guide rail arrangement to a wall containing the opening to be closed by the door leaf, the fastening arrangement comprising a plurality of fastening elements arranged to have a predetermined spacing between the individual fastening elements, each of the fastening elements can be fixed on one side to the wall and on the other side to the rail element; and tensioning means, which can be fixed in position at one end to the door leaf and at the other end to a drive device, a counterbalancing device or both a drive device and a counterbalancing device, where each of the fastening elements is configured substantially as an angle piece with two sidepieces enclosing an angle of 90° with each other, the two sidepieces including a first sidepiece attachable to the wall, and a second sidepiece attached to the rail element, wherein the guide rail arrangement is provided with at least one protective element, which can be attached to the fastening elements and which bridges the gap between the rail element and the wall, the protective element having a fastening area, and wherein the second sidepiece has a pressed-out section configured to form a receiving area for the fastening area of the protective element.

2. Door according to claim 1, wherein the protective element can be removably attached to at least one of the fastening elements or to the rail element or to both the rail element and at least one of the fastening elements.

3. Door according to claim 1, wherein a boundary surface of the fastening area has a profiling configured to arrive in contact with a boundary surface of the second sidepiece and prevent the protective element from separating from the fastening element.

4. Door according to claim 1, wherein the protective element has a cover area, where, between a boundary surface of the second sidepiece opposite the rail element and the cover area, an intermediate space is formed that is configured to receive the fastening means serving to attach the rail element to the second sidepiece.

5. Door according to claim 1, wherein the protective element consists at least partially of plastic.

6. Door according to claim 1, wherein the door leaf has a plurality of panels, which are hinged to each other with axes extending substantially perpendicular to the rail element.

7. Guide rail arrangement for a door having a door leaf that can be moved between an open position and a closed position, The guide rail arrangement comprising: a vertical rail element, which can be attached to a wall; a fastening arrangement with a plurality of fastening elements arranged to have a predetermined spacing between the individual fastening elements, each of the fastening elements can be attached on one side to the wall and on the other side to the vertical rail element; and at least one protective element, which can be attached to the rail element, to the fastening elements or to both the rail element and the fastening elements, and which bridges the gap formed between the rail element and the wall, where each of the fastening elements is configured substantially as an angle piece with two sidepieces enclosing an angle of 90° with each other, the two sidepieces including a first sidepiece attachable to the wall, and a second sidepiece attached to the rail element, wherein the second sidepiece has a pressed-out section configured to form a receiving area for the fastening area of the protective element.

* * * * *

UNITED STATES PATENT AND TRADEMARK OFFICE

CERTIFICATE OF CORRECTION

PATENT NO. : 7,089,990 B2
APPLICATION NO. : 10/509002
DATED : August 15, 2006
INVENTOR(S) : Thomas J. Hörmann et al.

It is certified that error appears in the above-identified patent and that said Letters Patent is hereby corrected as shown below:

Title page, item
[73] Assignee: should read --Hörmann KG Brockhagen, Steinhagen (DE)--

Signed and Sealed this

Twenty-seventh Day of February, 2007

JON W. DUDAS
*Director of the United States Patent and Trademark Office*